US007788945B2

(12) United States Patent
Mizutani et al.

(10) Patent No.: US 7,788,945 B2
(45) Date of Patent: Sep. 7, 2010

(54) AIR CONDITIONER, HEAT SOURCE UNIT, AND AIR CONDITIONER UPDATING METHOD

(75) Inventors: Kazuhide Mizutani, Sakai (JP); Akiharu Kojima, Sakai (JP); Shinya Matsuoka, Sakai (JP); Tetsuro Takamizo, Sakai (JP); Satoru Okura, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 210 days.

(21) Appl. No.: 11/792,860

(22) PCT Filed: Apr. 26, 2006

(86) PCT No.: PCT/JP2006/308720

§ 371 (c)(1),
(2), (4) Date: Jun. 12, 2007

(87) PCT Pub. No.: WO2006/118140

PCT Pub. Date: Nov. 9, 2006

(65) Prior Publication Data

US 2008/0053144 A1 Mar. 6, 2008

(30) Foreign Application Priority Data

Apr. 28, 2005 (JP) ..... 2005-132023

(51) Int. Cl.
*F25B 43/04* (2006.01)

(52) U.S. Cl. ..... 62/475; 62/474; 62/509

(58) Field of Classification Search ..... 62/77, 62/474, 475, 509, 195
See application file for complete search history.

(56) References Cited

U.S. PATENT DOCUMENTS

| | | | | |
|---|---|---|---|---|
| 4,617,808 | A * | 10/1986 | Edwards | 62/472 |
| 6,427,479 | B1 | 8/2002 | Komatsubara et al. | |
| 2002/0026800 | A1 * | 3/2002 | Kasai et al. | 62/85 |
| 2002/0194862 | A1 * | 12/2002 | Komatsubara et al. | 62/474 |

FOREIGN PATENT DOCUMENTS

| | | | |
|---|---|---|---|
| EP | 1 132 457 | A2 | 9/2001 |
| JP | 06-129738 | A | 5/1994 |
| JP | 09-236363 | A | 9/1997 |
| JP | 10-339526 | A | 12/1998 |
| JP | 2001-255043 | A | 9/2001 |
| JP | 2004-333121 | A | 11/2004 |
| JP | 2004333121 | A * | 11/2004 |

* cited by examiner

*Primary Examiner*—Frantz F. Jules
*Assistant Examiner*—Daniel C Comings
(74) *Attorney, Agent, or Firm*—Global IP Counselors

(57) ABSTRACT

An air conditioner is configured by appropriating existing refrigerant pipes of an existing air conditioner to update indoor units and an outdoor unit of a refrigerant circuit of the existing air conditioner. The air conditioner is disposed with an updated refrigerant circuit and a mixer disposed in the updated refrigerant circuit. The updated refrigerant circuit is filled with working refrigerant and refrigerating machine oil that include an acid trapping agent that detoxifies acid components remaining in the refrigerant pipes. The mixer mixes the acid components with the acid trapping agent during refrigeration cycle operation of the updated refrigerant circuit.

14 Claims, 6 Drawing Sheets

AIR CONDITIONER, HEAT SOURCE UNIT, AND AIR CONDITIONER UPDATING METHOD

CROSS-REFERENCE TO RELATED APPLICATIONS

This U.S. National stage application claims priority under 35 U.S.C. §119(a) to Japanese Patent Application No. 2005-132023, filed in Japan on Apr. 28, 2005, the entire contents of which are hereby incorporated herein by reference.

TECHNICAL FIELD

The present invention relates to an air conditioner, a heat source unit, and an air conditioner updating method.

BACKGROUND ART

As one conventional air conditioner, there is an air conditioner used to air condition a building or the like. Such an air conditioner is mainly disposed with a heat source unit including a compressor and heat source heat exchanger, a utilization unit including a utilization heat exchanger, and a gas refrigerant pipe and a liquid refrigerant pipe for interconnecting these units.

In such an air conditioner, when performing work to update the air conditioner in an existing building or the like, sometimes the gas refrigerant pipe and the liquid refrigerant pipe (called "existing refrigerant pipes" below) interconnecting the heat source unit and the utilization unit are appropriated in order to shorten the work period and reduce costs.

However, acid components generated by deterioration of the working refrigerant and refrigerating machine oil during operation of the air conditioner prior to update, and acid components stemming from moisture ingressing from the outside during the work of updating, remain inside the existing refrigerant pipes appropriated during the work of updating the air conditioner in a state where the acid components are mixed in with the refrigerating machine oil (called "existing refrigerating machine oil" below) that was used in the air conditioner prior to update. Such acid components compromise the reliability of devices that configure the air conditioner, such as the compressor, because the acid components deteriorate the working refrigerant and refrigerating machine oil filling the updated refrigerant circuit, so it is necessary to remove the acid components during test operation that is performed before normal air conditioning operation.

In order to counter this, trapping and removing moisture ingressing from the outside into the refrigerant circuit by disposing a dryer in the refrigerant circuit and performing refrigeration cycle operation during test operation after the air conditioner has been installed in a locality and maintenance has been performed is being considered (e.g., see Japanese Patent Publication No. 9-236363).

SUMMARY OF THE INVENTION

With a method using the aforementioned dryer, it is possible to control the occurrence of acid components because the moisture that is the source of the acid components can be removed. However, even when this method is applied to update an air conditioner by appropriating existing refrigerant pipes, it cannot remove acid components generated during operation of the existing air conditioner that remain in the existing refrigerant pipes and acid components stemming from moisture ingressing from the outside during the work of updating, and the method cannot control deterioration of the working refrigerant and refrigerating machine oil resulting from the acid components inside the updated refrigerant circuit.

Further, it is also conceivable to detoxify the acid components inside the refrigerant circuit of the updated air conditioner using a method that incorporates an acid trapping agent beforehand in the refrigerating machine oil to be used in the updated refrigerant circuit, to thereby reduce deterioration of the working refrigerant and refrigerating machine oil resulting from acid components in the updated refrigerant circuit, but there are problems in that there is a limit on the amount of the acid trapping agent capable of being incorporated in the refrigerating machine oil and, simply by incorporating an acid trapping agent beforehand in the refrigerating machine oil, deterioration of the working refrigerant and refrigerating machine oil cannot be promptly controlled because it takes time to cause the acid components and the acid trapping agent to react with each other inside the refrigerant circuit.

It is an object of the present invention to provide a configuration and updating method capable of promptly detoxifying acid components remaining in existing refrigerating pipes of a separate-type air conditioner when the existing refrigerant pipes are appropriated to update an outdoor unit and indoor units.

An air conditioner pertaining to a first aspect of the present invention is an air conditioner configured by appropriating, as existing refrigerant pipes, refrigerant pipes configuring an existing air conditioner to update at least some of devices configuring a refrigerant circuit of the existing air conditioner, the air conditioner comprising: an updated refrigerant circuit and a mixer. The updated refrigerant circuit includes a compressor, a heat source heat exchanger, an expansion mechanism, an utilization heat exchanger, and the existing refrigerant pipes, and is filled with working refrigerant and refrigerating machine oil that include an acid trapping agent that detoxifies acid components remaining in the existing refrigerant pipes. The mixer is disposed in the updated refrigerant circuit and mixes the acid components with the acid trapping agent during refrigeration cycle operation of the updated refrigerant circuit.

In this air conditioner, the mixer that mixes the acid components with the acid trapping agent is disposed in the updated refrigerant circuit, so the air conditioner can promote reaction between the acid components and the acid trapping agent during refrigeration cycle operation and can promptly detoxify the acid components remaining in the existing refrigerant pipes.

An air conditioner pertaining to a second aspect of the present invention comprises the air conditioner pertaining to the first aspect of the present invention, wherein the mixer is disposed such that the working refrigerant flowing through an intake pipe of the compressor passes through the inside of the mixer.

In this air conditioner, the mixer is disposed such that the working refrigerant flowing through the intake pipe of the compressor passes through the inside of the mixer, so the air conditioner can mix the acid components with the acid trapping agent before the working refrigerant is taken into the compressor during refrigeration cycle operation and can control inflow of the acid components into the compressor.

An air conditioner pertaining to a third aspect of the present invention comprises the air conditioner pertaining to the second aspect of the present invention, wherein the mixer is capable of collecting the refrigerating machine oil.

In this air conditioner, the air conditioner can collect the refrigerating machine oil inside the mixer, so the amount of time of contact between the acid components included in the refrigerating machine oil led into the mixer together with the working refrigerant and the refrigerating machine oil including the acid trapping agent becomes longer, and the air conditioner can promote mixing between the acid components and the acid trapping agent.

An air conditioner pertaining to a fourth aspect of the present invention comprises the air conditioner pertaining to the third aspect of the present invention, wherein the mixer is connected to the intake pipe of the compressor by a lead-in pipe and by a lead-out pipe. The lead-in pipe branches from the intake pipe of the compressor. The lead-out pipe branches from the intake pipe of the compressor at a position downstream of the position from where the lead-in pipe branches.

In this air conditioner, the mixer is connected to the intake pipe of the compressor by the lead-in pipe and by the lead-out pipe, so the air conditioner can lead the working refrigerant flowing through the intake pipe of the compressor into the mixer so as to bypass part of the intake pipe of the compressor and can again return the working refrigerant to the intake pipe of the compressor.

An air conditioner pertaining to a fifth, aspect of the present invention comprises the air conditioner pertaining to the fourth aspect of the present invention, wherein an intake pipe open/close mechanism capable of cutting off the flow of the working refrigerant is disposed in the intake pipe of the compressor between the position from where the lead-in pipe branches and the position from where the lead-out pipe branches.

In this air conditioner, the intake pipe open/close mechanism is disposed in the intake pipe, so the air conditioner can lead all of the working refrigerant flowing through the intake pipe of the compressor into the mixer and can again return the working refrigerant to the intake pipe of the compressor.

An air conditioner pertaining to a sixth aspect of the present invention comprises the air conditioner pertaining to any of the third to fifth aspects of the present inventions, wherein an oil lead-out pipe for returning the refrigerating machine oil collected inside the mixer to the intake pipe of the compressor is connected to the mixer.

In this air conditioner, the oil lead-out pipe for returning the refrigerating machine oil collected inside the mixer to the intake pipe of the compressor is connected to the mixer, and the air conditioner can return, to the intake pipe of the compressor, the refrigerating machine oil after the acid components and the acid trapping agent have been mixed and caused to react with each other such that the acid components are detoxified, so the air conditioner can further control inflow of the acid components into the compressor.

An air conditioner pertaining to a seventh aspect of the present invention comprises the air conditioner pertaining to the sixth aspect of the present invention, wherein an oil lead-out pipe open/close mechanism capable of cutting off the flow that returns the refrigerating machine oil collected inside the mixer to the intake pipe of the compressor is disposed in the oil lead-out pipe.

In this air conditioner, the oil lead-out pipe open/close mechanism is disposed in the oil lead-out pipe, so the air conditioner can lengthen the amount of time of contact between the acid components and the refrigerant machine oil including the acid trapping agent inside the mixer to further promote mixing between the acid components and the acid trapping agent and can rapidly return the refrigerating machine oil to the intake pipe of the compressor after mixing ends.

An air conditioner pertaining to an eighth aspect of the present invention comprises the air conditioner pertaining to any of the third to seventh aspects of the present inventions, wherein the mixer is filled with the refrigerating machine oil including the acid trapping agent before the start of the refrigeration cycle operation.

In this air conditioner, the mixer is filled with the refrigerating machine oil including the acid trapping agent before the start of the updated refrigeration cycle operation, so the air conditioner can promptly and reliably mix, with the acid trapping agent, the acid components included in the refrigerating machine oil flowing into the mixer together with the working refrigerant immediately after the start of the refrigeration cycle operation.

A heat source unit pertaining to a ninth aspect of the present invention is a heat source unit used in an air conditioner configured by appropriating, as existing refrigerant pipes, refrigerant pipes configuring an existing air conditioner to update at least some of devices configuring a refrigerant circuit of the existing air conditioner, the heat source unit comprising: a heat source refrigerant circuit and a mixer. The heat source refrigerant circuit includes a compressor and a heat source heat exchanger and is filled with working refrigerant and refrigerating machine oil that include an acid trapping agent that detoxifies acid components remaining in the existing refrigerant pipes. The mixer is disposed in the heat source refrigerant circuit and mixes the acid components with the acid trapping agent during refrigeration cycle operation after configuring an updated refrigerant circuit including the existing refrigerant pipes and the heat source refrigerant circuit.

In this heat source unit, the mixer that mixes the acid components with the acid trapping agent is disposed in the heat source refrigerant circuit, so the heat source unit can promote reaction between the acid components and the acid trapping agent and can promptly detoxify the acid components remaining in the existing refrigerant pipes during refrigeration cycle operation after configuring the updated refrigerant circuit including the existing refrigerant pipes and the heat source refrigerant circuit.

An air conditioner updating method pertaining to a tenth aspect of the present invention is an air conditioner updating method that appropriates, as existing refrigerant pipes, refrigerant pipes configuring an existing air conditioner disposed with a vapor compression-type refrigerant circuit to update at least some of devices configuring a refrigerant circuit of the existing air conditioner, the method comprising: a refrigerant recovery step, a device updating step, and a test operation step. The refrigerant recovery step recovers working refrigerant including refrigerating machine oil from the existing air conditioner. The device updating step updates at least some of devices configuring the existing air conditioner to configure an updated vapor compression-type refrigerant circuit filled with working refrigerant and refrigerating machine oil that include an acid trapping agent that detoxifies acid components remaining in the existing refrigerant pipes, with the device updating step disposing in the updated refrigerant circuit a mixer that mixes the acid components with the acid trapping agent. The test operation step performs refrigeration cycle operation of the updated refrigerant circuit such that working refrigerant passes through the inside of the mixer.

In this air conditioner updating method, the method can promote, in the test operation step with the mixer disposed in the updated refrigerant circuit, reaction between the acid components remaining in the existing refrigerant pipes after the refrigerant recovery step and the acid trapping agent filled together with the working refrigerant and the refrigerating machine oil in the device updating step, and can promptly detoxify the acid components remaining in the existing refrigerant pipes.

An air conditioner updating method pertaining to an eleventh aspect of the present invention comprises the air conditioner updating method pertaining to the tenth aspect of the present invention, wherein during the test operation step, the acid components are mixed with the acid trapping agent by collecting the refrigerating machine oil inside the mixer.

In this air conditioner updating method, the method can collect the refrigerating machine oil inside the mixer, so the amount of time of contact between the acid components included in the refrigerating machine oil led into the mixer together with the working refrigerant and the refrigerating machine oil including the acid trapping agent becomes longer, and the method can promote mixing between the acid components and the acid trapping agent.

An air conditioner updating method pertaining to a twelfth aspect of the present invention comprises the air conditioner updating method pertaining to the eleventh aspect of the present invention, wherein at the end of the test operation step, the refrigerating machine oil collecting inside the mixer is returned to the inside of the updated refrigerant circuit.

In this air conditioner updating method, the method can rapidly return the refrigerating machine oil to the inside of the updated refrigerant circuit after mixing between the acid components and the refrigerating machine oil including the acid trapping agent inside the mixer ends.

An air conditioner updating method pertaining to a thirteenth aspect of the present invention comprises the air conditioner updating method pertaining to the eleventh or twelfth aspect of the present invention, wherein the mixer is filled with the refrigerating machine oil including the acid trapping agent before the test operation step.

In this air conditioner updating method, the mixer is filled with the refrigerating machine oil including the acid trapping agent before the test operation step, so the method can promptly and reliably mix, with the acid trapping agent, the acid components included in the refrigerating machine oil flowing into the mixer together with the working refrigerant immediately after the start of refrigeration cycle operation during the test operation step.

DETAILED DESCRIPTION OF THE INVENTION

Embodiments of the present invention will be described below on the basis of the drawings.

(1) Configuration of Existing Air Conditioner

<Overall Configuration>

Figure 1:
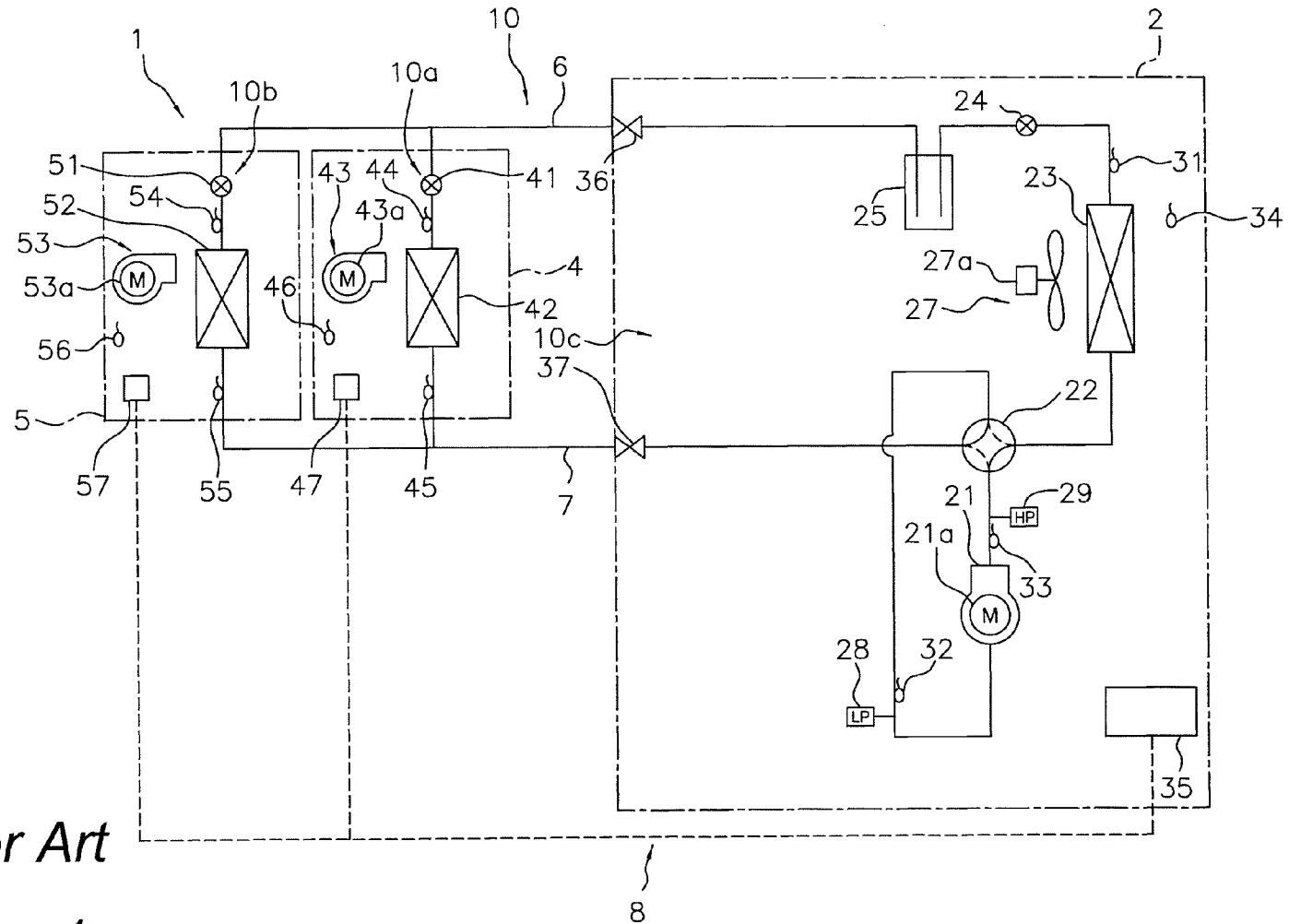
Prior Art Fig. 1
FIG. 1 is a general configural diagram of an existing air conditioner.

FIG. 1 is a schematic configural diagram of an existing air conditioner 1. The existing air conditioner 1 is an apparatus used for air conditioning such as cooling and heating the inside of a building or the like, and is disposed with one outdoor unit 2 serving as a heat source unit, plural (two in the present embodiment) indoor units 4 and 5 serving as utilization units connected to the outdoor unit 2, and a liquid refrigerant communication pipe 6 and a gas refrigerant communication pipe 7 for interconnecting the outdoor unit 2 and the indoor units 4 and 5. Additionally, a vapor compression-type refrigerant circuit 10 of the existing air conditioner 1 is configured by the interconnection of the outdoor unit 2 and the indoor units 4 and 5 via the liquid refrigerant communication pipe 6 and the gas refrigerant communication pipe 7.

<Indoor Units>

The indoor units 4 and 5 are installed in places inside a building or the like. The indoor units 4 and 5 are connected to the outdoor unit 2 via the liquid refrigerant communication pipe 6 and the gas refrigerant communication pipe 7 and respectively configure indoor refrigerant circuits 10*a* and 10*b* serving as utilization refrigerant circuits that are part of the refrigerant circuit 10.

Next, the configuration of the indoor units 4 and 5 will be described. It will be noted that, because the indoor unit 4 and the indoor unit 5 have the same configuration, just the configuration of the indoor unit 4 will be described here, and in regard to the configuration of the indoor unit 5, reference numerals in the 50s will be used instead of reference numerals in the 40s representing the respective parts of the indoor unit 4, and description of those respective parts will be omitted.

As mentioned previously, the indoor unit 4 is mainly disposed with the indoor refrigerant circuit 10*a* (in the indoor unit 5, the indoor refrigerant circuit 10*b*) that configures part of the refrigerant circuit 10. The indoor refrigerant circuit 10*a* is mainly disposed with an indoor expansion valve 41 serving as a utilization expansion mechanism and an indoor heat exchanger 42 serving as a utilization heat exchanger.

In the present embodiment, the indoor, expansion valve 41 is an electrically powered expansion valve connected to a liquid side of the indoor heat exchanger 42 in order to regulate the flow rate of working refrigerant flowing inside the indoor refrigerant circuit 10*a*.

In the present embodiment, the indoor heat exchanger 42 is a cross fin type fin-and-tube heat exchanger configured by a heat exchanger tube and numerous fins, and is a heat exchanger that functions as an evaporator of the working refrigerant to cool room air during cooling operation and functions as a condenser of the working refrigerant to heat room air during heating operation.

In the present embodiment, the indoor unit 4 is disposed with an indoor fan 43 for taking room air into the unit, performing heat exchange, and thereafter supplying the air into the room as supply air, so that the indoor unit 4 is capable of causing heat to be exchanged between the room air and the working refrigerant flowing through the indoor heat exchanger 42. The indoor fan 43 is a fan capable of varying the flow rate of the air it supplies to the indoor heat exchanger 42 and, in the present embodiment, comprises a centrifugal fan or a multiblade fan that is driven by a motor 43*a* comprising a DC fan motor.

Further, various sensors are disposed in the indoor unit 4. A liquid temperature sensor 44 that detects the temperature of the working refrigerant in a liquid state or a gas-liquid two-phase state is disposed on the liquid side of the indoor heat exchanger 42. A gas temperature sensor 45 that detects the temperature of the working refrigerant in a gas state or a gas-liquid two-phase state is disposed on a gas side of the indoor heat exchanger 42. A room air temperature sensor 44 that detects the temperature of the room air flowing into the unit is disposed on a room air intake opening side of the indoor unit 4. In the present embodiment, the liquid temperature sensor 44, the gas temperature sensor 45, and the room air temperature sensor 46 comprise thermistors. Further, the indoor unit 4 is disposed with an indoor controller 47 that controls the operation of each part configuring the indoor unit 4. Additionally, the indoor controller 47 includes a microcomputer and a memory disposed in order to control the indoor unit 4, and is configured such that it can exchange control signals and the like with a remote controller (not shown) and can exchange control signals and the like with the outdoor unit 2.

<Outdoor Unit>

The outdoor unit 2 is installed on the roof or the like of a building or the like. The outdoor unit 2 is connected to the indoor units 4 and 5 via the liquid refrigerant communication pipe 6 and the gas refrigerant communication pipe 7 and configures an outdoor refrigerant circuit 10*c* serving as a heat source refrigerant circuit that is part of the refrigerant circuit 10.

Next, the configuration of the outdoor unit 2 will be described. As mentioned above, the outdoor unit 2 is mainly disposed with the outdoor refrigerant circuit 10*c* that configures part of the refrigerant circuit 10. The outdoor refrigerant circuit 10*c* is mainly disposed with a compressor 21, a four-way switch valve 22, an outdoor heat exchanger 23 serving as a heat source heat exchanger, an outdoor expansion valve 24 serving as a heat source expansion valve, a receiver 25, a liquid close valve 36, and a gas close valve 37.

The compressor 21 is a compressor whose operational capacity can be varied, and is a positive displacement type compressor driven by a motor 21 a controlled by an inverter. In the present embodiment, the compressor 21 comprises only a single compressor but is not limited to this and may also be one where two or more compressors are connected in parallel in accordance with the number of connected indoor units.

The four-way switch valve 22 is a valve for switching the direction of the flow of the working refrigerant such that, during cooling operation, the four-way switch valve 22 is capable of connecting a discharge side of the compressor 21 and a gas side of the outdoor heat exchanger 23 and connecting an intake side of the compressor 21 and the gas refrigerant communication pipe 7 (see the solid lines of the four-way switch valve 22 in FIG. 1) to cause the outdoor heat exchanger 23 to function as a condenser of the working refrigerant compressed in the compressor 21 and to cause the indoor heat exchangers 42 and 52 to function as evaporators of the working refrigerant condensed in the outdoor heat exchanger 23, and such that, during heating operation, the four-way switch valve 22 is capable of connecting the discharge side of the compressor 21 and the gas refrigerant communication pipe 7 and connecting the intake side of the compressor 21 and the gas side of the outdoor heat exchanger 23 (see the dotted lines of the four-way switch valve 22 in FIG. 1) to cause the indoor heat exchangers 42 and 52 to function as condensers of the working refrigerant compressed in the compressor 21 and to cause the outdoor heat exchanger 23 to function as an evaporator of the working refrigerant condensed in the indoor heat exchangers 42 and 52.

In the present embodiment, the outdoor heat exchanger 23 is a cross fin type fin-and-tube heat exchanger configured by a heat exchanger tube and numerous fins, and is a heat exchanger that functions as a condenser of the working refrigerant during cooling operation and functions as an evaporator of the working refrigerant during heating operation. The gas side of the outdoor heat exchanger 23 is connected to the four-way switch valve 22, and the liquid side of the outdoor heat exchanger 23 is connected to the liquid refrigerant communication pipe 6.

In the present embodiment, the outdoor unit 2 is disposed with an outdoor fan 27 for taking outdoor air into the unit, supplying the outdoor air to the outdoor heat exchanger 23, and thereafter discharging the air to the outside, so that the outdoor unit 2 is capable of causing heat to be exchanged between the outdoor air and the working refrigerant flowing through the outdoor heat exchanger 23. The outdoor fan 27 is a fan capable of varying the flow rate of the air it supplies to the outdoor heat exchanger 23 and, in the present embodiment, comprises a propeller fan that is driven by a motor 27*a* comprising a DC fan motor.

In the present embodiment, the outdoor expansion valve 24 is an electrically powered expansion valve connected to a liquid side of the outdoor heat exchanger 23 in order to regulate the flow rate of the working refrigerant flowing inside the outdoor refrigerant circuit 10*c*.

The receiver 25 is connected between the outdoor expansion valve 24 and the liquid close valve 36, and is a container capable of collecting excess refrigerant generated inside the refrigerant circuit 10 in accordance with the operation loads of the indoor units 4 and 5.

The liquid close valve 36 and the gas close valve 37 are valves disposed at ports connected to external devices/pipes (specifically, the liquid refrigerant communication pipe 6 and the gas refrigerant communication pipe 7). The liquid close valve 36 is connected to the receiver 25. The gas close valve 37 is connected to the four-way switch valve 22.

Further, various sensors are disposed in the outdoor unit 2. Specifically, disposed in the outdoor unit 2 are an intake pressure sensor 28 that detects the intake pressure of the compressor 21, a discharge pressure sensor 29 that detects the discharge pressure of the compressor 21, an intake temperature sensor 32 that detects the intake temperature of the compressor 21, and a discharge temperature sensor 33 that detects the discharge temperature of the compressor 21. A liquid temperature sensor 31 that detects the temperature of the working refrigerant in a liquid state or a gas-liquid two-phase state is disposed on the liquid side of the outdoor heat exchanger 23. An outdoor air temperature sensor 34 that detects the temperature of the outdoor air flowing into the unit is disposed on an outdoor air intake opening side of the outdoor unit 2. Further, the outdoor unit 2 is disposed with an outdoor controller 35 that controls the operation of each part configuring the outdoor unit 2. Additionally, the outdoor controller 35 includes a microcomputer and a memory disposed in order to control the outdoor unit 2 and an inverter circuit that controls the motor 21*a*, and is configured such that it can exchange control signals and the like with the indoor controllers 47 and 57 of the indoor units 4 and 5. That is, a controller 8 that controls operation of the entire air conditioner 1 is configured by the indoor controllers 47 and 57 and by the outdoor controller 35. The controller 8 is connected such that it can receive detection signals of the various sensors 28, 29, 31 to 34, 44 to 46, and 54 to 56, and is connected such that it can control the various devices and valves 21, 22, 24, 27*a*, 41, 43*a*, 51, and 53*a* on the basis of these detection signals.

<Refrigerant Communication Pipes>

The liquid refrigerant communication pipe 6 and the gas refrigerant communication pipe 7 are refrigerant pipes that interconnect the outdoor unit 2 and the indoor units 4 and 5, and the major portions thereof are disposed on the backside of a wall or the backside of a ceiling inside a building. Additionally, they are appropriated as existing refrigerant pipes during later-described updating of the air conditioner 1.

As described above, the refrigerant circuit 10 of the air conditioner 1 is configured by the interconnection of the indoor refrigerant circuits 10*a* and 10*b*, the outdoor refrigerant circuit 10*c*, and the refrigerant communication pipes 6 and 7. Additionally, the air conditioner 1 of the present embodiment is configured to perform operation by switching between cooling operation and heating operation as a result of the four-way switch valve 22 being switched by the controller 8 configured by the indoor controllers 47 and 57 and the outdoor controller 35 and to control the various devices of the outdoor unit 2 and the indoor units 4 and 5 in accordance with the operation loads of the indoor units 4 and 5.

(2) Operation of Existing Air Conditioner

Next, operation of the existing air conditioner 1 will be described using FIG. 1.

<Cooling Operation>

During cooling operation, the four-way switch valve 22 is in the state represented by the solid lines in FIG. 1, that is, a state where the discharge side of the compressor 21 is connected to the gas side of the outdoor heat exchanger 23 and where the intake side of the compressor 21 is connected to the gas sides of the indoor heat exchangers 42 and 52. Further, the outdoor expansion valve 24, the liquid close valve 36, and the gas close valve 37 are open.

When the compressor 21, the outdoor fan 27, and the indoor fans 43 and 53 are started in this state of the refrigerant circuit 10, working refrigerant in a low-pressure gas state is taken into the compressor 21, compressed, and becomes working refrigerant in a high-pressure gas state. Thereafter, the working refrigerant in the high-pressure gas state is sent to the outdoor heat exchanger 23 via the four-way switch valve 22, condensed as a result of heat exchange being performed with the outdoor air supplied by the outdoor fan 27, and becomes working refrigerant in a high-pressure liquid state.

Then, the working refrigerant in the high-pressure liquid state is sent to the receiver 25 via the outdoor expansion valve 24, temporarily collected inside the receiver 25, and sent to the indoor units 4 and 5 via the liquid close valve 36 and the liquid refrigerant communication pipe 6. Here, in accordance with the operation loads of the indoor units 4 and 5, when excess refrigerant is generated inside the refrigerant circuit 10, such as when one of the operation loads of the indoor units 4 and 5 is small or is stopped, or when both of the operation loads of the indoor units 4 and 5 are small, then that excess refrigerant is collected inside the receiver 25.

The working refrigerant in the high-pressure liquid state sent to the indoor units 4 and 5 is depressurized by the indoor expansion valves 41 and 51 whose openings are regulated so as to regulate the flow rate of the working refrigerant flowing through the indoor heat exchangers 42 and 52, becomes working refrigerant in a low-pressure gas-liquid two-phase state, is sent to the indoor heat exchangers 42 and 52, evaporated as a result of heat exchange being performed with the room air in the indoor heat exchangers 42 and 52, and becomes working refrigerant of a low-pressure gas state.

The working refrigerant in the low-pressure gas state is sent to the outdoor unit 2 via the gas refrigerant communication pipe 7 and is again taken into the compressor 21 via the gas close valve 37 and the four-way switch valve 22.

<Heating Operation>

During heating operation, the four-way switch valve 22 is in the state represented by the dotted lines in FIG. 1, that is, a state where the discharge side of the compressor 21 is connected to the gas sides of the indoor heat exchangers 42 and 52 and where the intake side of the compressor 21 is connected to the gas side of the outdoor heat exchanger 23. Further, the outdoor expansion valve 24, the liquid close valve 36, and the gas close valve 37 are open.

When the compressor 21, the outdoor fan 27, and the indoor fans 43 and 53 are started in this state of the refrigerant circuit 10, working refrigerant in a low-pressure gas state is taken into the compressor 21, compressed, becomes working refrigerant in a high-pressure gas state, and is sent to the indoor units 4 and 5 via the four-way switch valve 22, the gas close valve 37, and the gas refrigerant communication pipe 7.

Then, the working refrigerant in the high-pressure gas state sent to the indoor units 4 and 5 is condensed as a result of heat exchange being performed with room air in the indoor heat exchangers 42 and 52, becomes working refrigerant in a high-pressure liquid state, is depressurized by the indoor expansion valves 41 and 51 whose openings are regulated so as to regulate the flow rate of the working refrigerant flowing through the indoor heat exchangers 42 and 52, and becomes working refrigerant in a low-pressure gas-liquid two-phase state.

The working refrigerant in the low-pressure gas-liquid two-phase state is sent to the outdoor unit 2 via the liquid refrigerant communication pipe 6 and flows into the receiver 25 via the liquid close valve 36. The working refrigerant flowing into the receiver 25 is temporarily collected inside the receiver 25 and flows into the outdoor heat exchanger 23 via the outdoor expansion valve 24. Here, in accordance with the operation loads of the indoor units 4 and 5, when excess refrigerant is generated inside the refrigerant circuit 10, such as when one of the operation loads of the indoor units 4 and 5 is small or is stopped, or when both of the operation loads of the indoor units 4 and 5 are small, then that excess refrigerant is collected inside the receiver 25. Then, the working refrigerant in the low-pressure gas-liquid two-phase state flowing into the outdoor heat exchanger 23 is condensed as a result of heat exchange being performed with the outdoor air supplied by the outdoor fan 27, becomes working refrigerant in a low-pressure gas state, and is again taken into the compressor 21 via the four-way switch valve 22.

It will be noted that, during the aforementioned cooling operation and heating operation, the controller 8 functions as normal operation control means for performing normal refrigeration cycle operation including the aforementioned cooling operation and heating operation.

(3) Updating Existing Air Conditioner (A) Regarding Working Refrigerant and Refrigerating Machine Oil Used in Existing Air Conditioner In the existing air conditioner 1, working refrigerant circulates inside the refrigerant circuit 10 during normal refrigeration cycle operation such as the aforementioned cooling operation and heating operation. Additionally, refrigerating machine oil filling the inside of the refrigerant circuit 10 together with the working refrigerant also circulates inside the refrigerant circuit 10 in a state where it is somewhat mixed with the working refrigerant. For this reason, in the existing air conditioner 1 where the aforementioned refrigeration cycle operation has been performed, the refrigerating machine oil (called "existing refrigerating machine oil" below) remains somewhat inside the refrigerant circuit 10 after the working refrigerant including the refrigerating machine oil filling the inside of the refrigerant circuit 10 has been recovered during later-described updating work. Mixed in with this existing refrigerant machine oil are acid components generated by deterioration of the working refrigerant and refrigerating machine oil during refrigeration cycle operation of the existing air conditioner 1 and acid components stemming from moisture ingressing from the outside during the work of the later-described updating work.

In the present embodiment, a chlorofluorocarbon (CFC) refrigerant or a hydrochlorofluorocarbon (HCFC) refrigerant such as R22 or the like is used as the working refrigerant in the existing air conditioner 1, and alkyl benzene, mineral oil or the like is used as the refrigerating machine oil. Additionally, when a CFC refrigerant or an HCFC refrigerant such as R22 is used as the working refrigerant in the existing air conditioner 1, hydrochloric acid, carboxylic acid and the like are generated as acid components.

(B) Regarding Updating Indoor Units and Outdoor Unit

Figure 2:
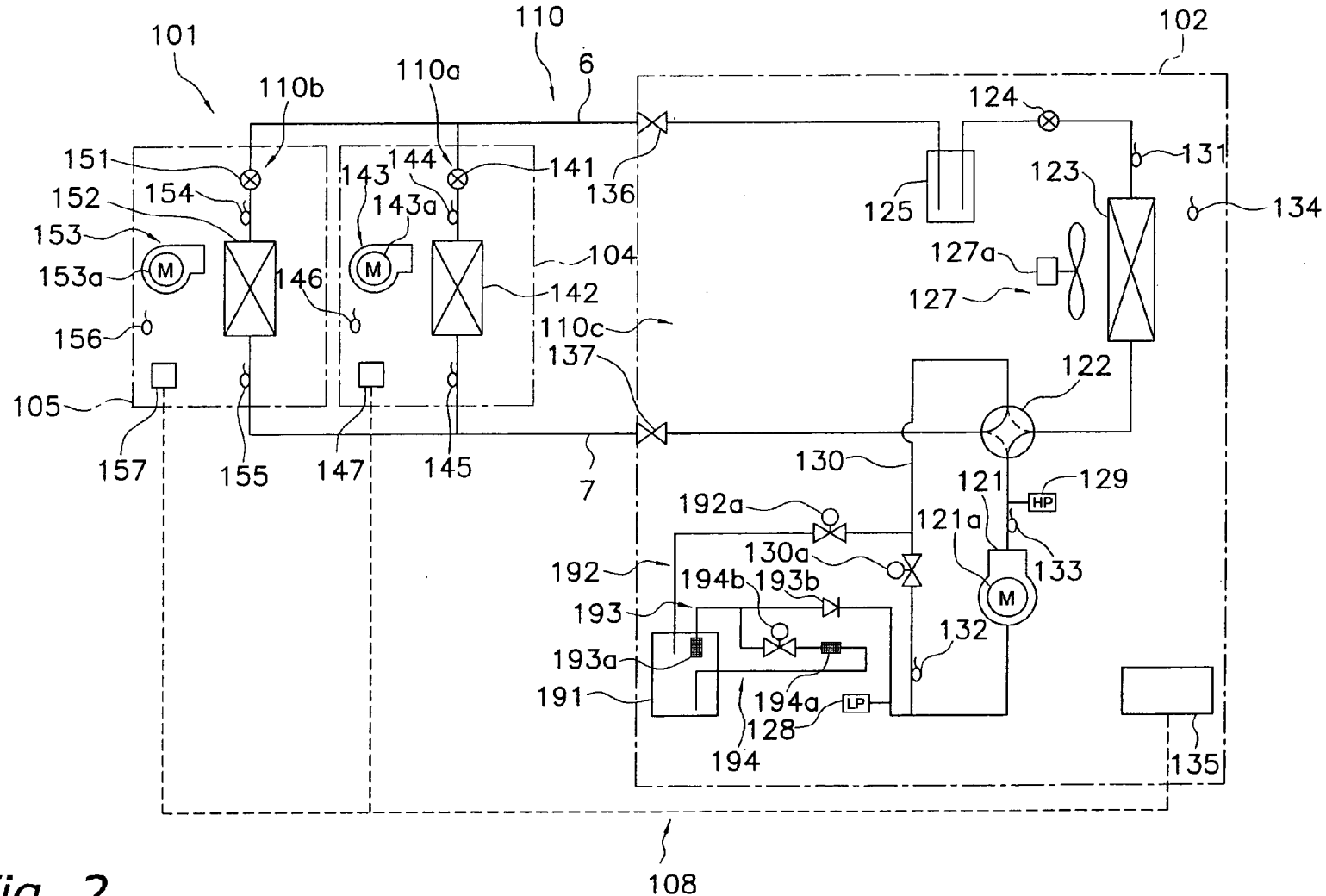
FIG. 2 is a general configural diagram of an updated air conditioner pertaining to an embodiment of the present invention.
Figure 3:
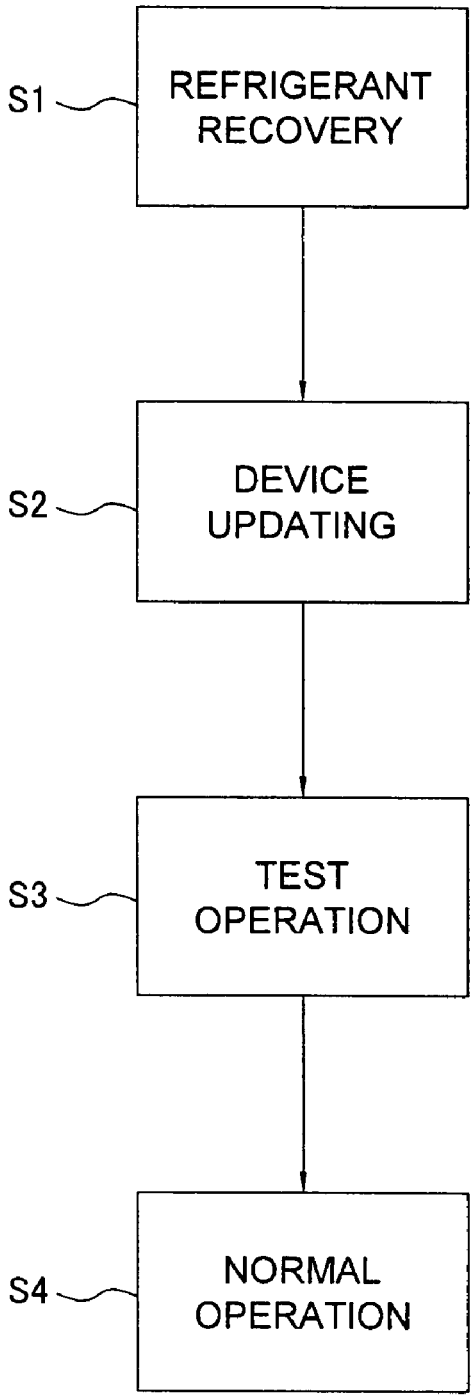
FIG. 3 is a flowchart showing the sequence of an air conditioner updating method pertaining to an embodiment of the present invention.

Next, a method of appropriating, as existing refrigerant pipes, the refrigerant communication pipes 6 and 7 of the existing air conditioner 1 and updating the indoor units 4 and 5 and the outdoor unit 2 to indoor units 104 and 105 serving as utilization units and an outdoor unit 102 serving as a heat source unit to configure an air conditioner 101 will be described on the basis of FIG. 2 and FIG. 3. It will be noted that, in the present embodiment, the working refrigerant used in the updated air conditioner 101 is changed to a hydrochlorofluorocarbon (HCFC) refrigerant such as R407C, R410A or the like instead of the CFC refrigerant or HCFC refrigerant such as R22 or the like that had been used in the existing air conditioner 1. Further, in accompaniment with the change in the working refrigerant, ethereal oil or ester oil whose compatibility with the HFC refrigerant is high is used for the refrigerating machine oil instead of the alkyl benzene, mineral oil or the like serving as the existing refrigerating machine oil. Here, FIG. 2 is a general configural diagram of the updated air conditioner 101 pertaining to an embodiment of the present invention. FIG. 3 is a flowchart showing the sequence of an air conditioner updating method pertaining to an embodiment of the present invention.

<Refrigerant Recovery Step S1>

In the present embodiment, pump down operation is performed in order to recover the working refrigerant including the existing refrigerating machine oil inside the existing air conditioner 1. That is, refrigeration cycle operation that is the same as the aforementioned cooling operation is performed in a state where the liquid close valve 36 of the outdoor unit 2 is closed, whereby the working refrigerant including the existing refrigerating machine oil is forced inside the outdoor unit 2, and thereafter the gas close valve 37 is closed and refrigeration cycle operation is ended to recover the working refrigerant including the existing refrigerating machine oil inside the outdoor unit 2.

<Device Updating Step S2>

Next, the indoor units 4 and 5 and the outdoor unit 2 that had configured the existing air conditioner 1 are removed and thereafter the new indoor units 104 and 105 and the new outdoor unit 102 are installed and connected to the refrigerant communication pipes 6 and 7 appropriated as existing refrigerant pipes to configure a vapor compression type refrigerant circuit 110 of the updated air conditioner 101.

Here, the configurations of the new indoor units 104 and 105 and the new outdoor unit 102 will be described.

<Indoor Units>

Similar to the existing indoor units 4 and 5, the indoor units 104 and 105 are installed in places inside a building or the like. The indoor units 104 and 105 respectively configure indoor refrigerant circuits 110*a* and 110*b* serving as utilization refrigerant circuits that are part of the updated refrigerant circuit 110.

Next, the configuration of the indoor units 104 and 105 will be described. It will be noted that, because the indoor unit 104 and the indoor unit 105 have the same configuration, just the configuration of the indoor unit 104 will be described here. Further, similar to the existing indoor unit 4, the indoor unit 104 includes an indoor expansion valve 141 serving as a utilization expansion valve, an indoor heat exchanger 142 serving as a utilization heat exchanger, an indoor fan 143 that is driven by a motor 143*a*, a liquid temperature sensor 144, a gas temperature sensor 145, a room air temperature sensor 146, and an indoor controller 147. Because these devices 141 to 147 have the same purposes and functions as those of the devices 41 to 47 configuring the existing indoor unit 4, description of each part will be omitted.

<Outdoor Unit>

Similar to the existing outdoor unit 2, the outdoor unit 102 is installed on the roof or the like of a building or the like. The outdoor unit 2 configures an outdoor refrigerant circuit 110*c* serving as a heat source refrigerant circuit that is part of the updated refrigerant circuit 110.

Next, the configuration of the outdoor unit 102 will be described. Similar to the existing outdoor unit 2, the outdoor unit 102 includes a compressor 121, a four-way switch valve 122, an outdoor heat exchanger 123 serving as a heat source heat exchanger, an outdoor expansion valve 124 serving as a heat source expansion valve, a receiver 125, a liquid close valve 136, a gas close valve 137, an outdoor fan 127 that is driven by a motor 127*a*, an intake pressure sensor 128, a discharge pressure sensor 129, an intake temperature sensor 132, a discharge temperature sensor 133, a liquid temperature sensor 131, an outdoor air temperature sensor 134, and an outdoor controller 135. Because these devices 121 to 125, 127 to 129, and 131 to 135 have the same purposes and functions as those of the devices 21 to 25, 27 to 29, and 31 to 35 configuring the existing outdoor unit 2, description of each part will be omitted.

Additionally, a controller 108 that controls operation of the entire air conditioner 101 is configured by the indoor controllers 147 and 157 and the outdoor controller 135 and, in later-described normal operation step S4, functions as normal operation control means for performing normal refrigeration cycle operation including cooling operation and heating operation that are the same as those in the existing air conditioner 1.

Further, in contrast to the existing outdoor unit 2, the outdoor unit 102 is further disposed with a mixer 191 in addition to the aforementioned configuration. That is, the mixer 191 is disposed in the updated refrigerant circuit 110 (specifically, the outdoor refrigerant circuit 110*c*).

Figure 4:
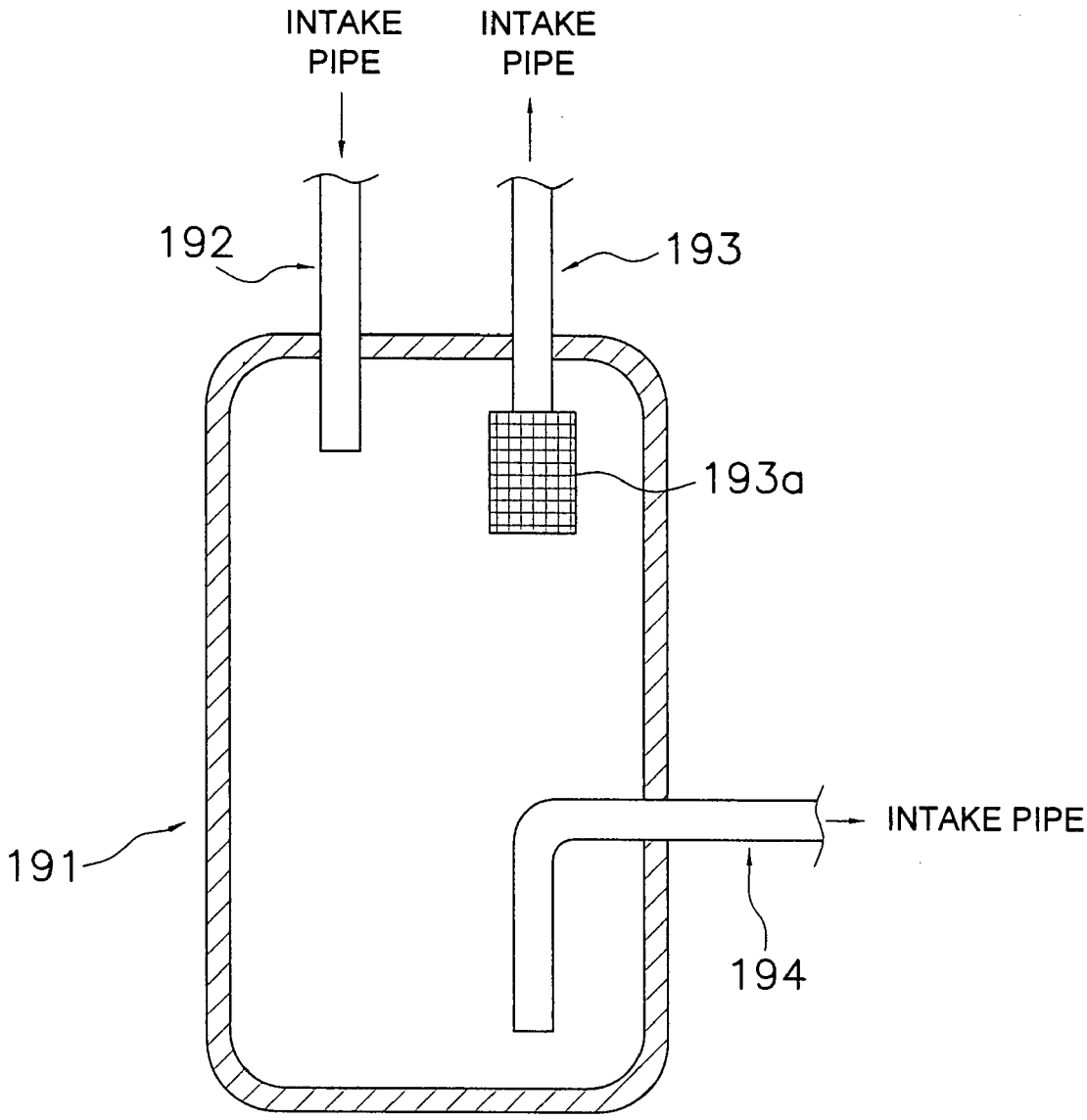
FIG. 4 is a general cross-sectional diagram of a mixer.

The mixer 191 is a device for mixing, in a later-described test operation step S3, the acid components remaining in the refrigerant communication pipes 6 and 7 serving as existing refrigerant pipes with an acid trapping agent that detoxifies these acid components. In the present embodiment, the mixer 191 is disposed such that working refrigerant in a low-pressure gas state flowing through an intake pipe 130 of the compressor 121 passes through the inside of the mixer 191. Here, the intake pipe 130 is a refrigerant pipe that interconnects the four-way switch valve 122 and the compressor 121. Further, in the present embodiment, the mixer 191 is a container shaped like a vertical circular cylinder as shown in FIG. 4, and is capable of collecting refrigerating machine oil inside. The mixer 191 is connected to the intake pipe 130 by a lead-in pipe 192 that branches from the intake pipe 130 and by a lead-out pipe 193 that branches from the intake pipe 130 at a position downstream of the position from where the lead-in pipe 192 branches. That is, the mixer 191 is disposed so as to bypass part of the intake pipe 130. Here, FIG. 4 is a general cross-sectional diagram of the mixer 191.

Part of the lead-in pipe 192 is inserted inside the mixer 191 from the upper portion of the mixer 191, and an end portion of the lead-in pipe 192 extends as far as the space in the upper portion of the mixer 191. That is, the working refrigerant to be led into the mixer 191 through the lead-in pipe 192 from the intake pipe 130 is led in from the vicinity of the top portion of the mixer 191. Additionally, a lead-in pipe open/close valve 192*a* serving as a lead-in pipe open/close mechanism capable of cutting off the flow of the working refrigerant in the low-pressure gas state led into the mixer 191 from the intake pipe 130 is disposed in the lead-in pipe 192. In the present embodiment, the lead-in pipe open/close valve 192*a* comprises an electromagnetic valve.

Similar to the aforementioned lead-in pipe 192, part of the lead-out pipe 193 is inserted inside the mixer 191 from the upper portion of the mixer 191, and an end portion of the lead-out pipe 193 extends as far as the vicinity of the top portion of the mixer 191. That is, the working refrigerant to be returned to the intake pipe 130 through the lead-out pipe 193 from the mixer 191 is led out from the space in the upper portion of the mixer 191. Additionally, a filter 193*a* is disposed on the end portion of the lead-out pipe 193 inserted into the mixer 191. Further, disposed in the lead-out pipe 193 is a lead-out pipe check valve 193*b* serving as a check mechanism capable of allowing the flow that returns the working refrigerant led out from the mixer 191 to the intake pipe 130 and cutting off the flow where the working refrigerant flows into the mixer 191 from the intake pipe 130.

Further, an intake pipe open/close valve 130*a* serving as an intake pipe open/close mechanism capable of cutting off the flow of the working refrigerant is disposed in the intake pipe 130 between the position from where the lead-in pipe 192 branches and the position from where the lead-out pipe 193 branches. In the present embodiment, the intake pipe open/close valve 130*a* comprises an electromagnetic valve.

Moreover, an oil lead-out pipe 194 for returning the refrigerating machine oil collected inside the mixer 191 to the intake pipe 130 is connected to the mixer 191. Part of the oil lead-out pipe 194 is inserted inside the mixer 191 from the side portion of the mixer 191, and an end portion of the oil lead-out pipe 194 extends as far as the space in the lower portion of the mixer 191. Further, the oil lead-out pipe 194 merges with the lead-out pipe 193. Specifically, the oil lead-out pipe 194 is connected to a position at the mixer 191 side of the lead-out pipe check valve 193*b* of the lead-out pipe 193. Thus, the refrigerating machine oil returned to the intake pipe 130 through part of the oil lead-out pipe 194 and the lead-out pipe 193 from the mixer 191 is led out from the vicinity of the bottom portion of the mixer 191. Additionally, disposed in the oil lead-out pipe 194 are a filter 194*a* and an oil lead-out pipe open/close valve 194*b* serving as an oil lead-out pipe open/close mechanism capable of cutting off the flow that returns the refrigerating machine oil collected inside the mixer 191 to the intake pipe 130. In the present embodiment, the oil lead-out pipe open/close valve 194*b* comprises an electromagnetic valve.

Additionally, similar to the other devices and valves, the aforementioned intake pipe open/close valve 130*a*, the lead-in pipe open/close valve 192*a*, and the oil lead-out pipe open/close valve 194*b* are controlled by the controller 108 (specifically, the outdoor controller 135) of the updated air conditioner 101.

Further, the inside of the outdoor refrigerant circuit 110*c* of the outdoor unit 102 is filled with predetermined amounts of the R410A serving as the aforementioned working refrigerant and the ethereal oil or ester oil serving as the refrigerating machine oil before the outdoor unit 102 is transported to the installation site. At this time, an acid trapping agent that detoxifies the acid components remaining in the refrigerant communication pipes 6 and 7 serving as existing refrigerant pipes is added to the refrigerating machine oil during acid component detoxification operation in the later-described test operation step S3. Here, detoxification refers to causing the acid components to lose their ability to deteriorate the working refrigerant and the refrigerating machine oil, and a substance that neutralizes the acid components—specifically, an epoxy compound or the like—can be used as the acid trapping agent capable of performing such detoxification. The acid trapping agent is added in an amount within the range of 0.01 wt % or more and 10 wt % or less with respect to the weight of the injected refrigerating machine oil. It will be noted that, in the present embodiment, the refrigerating machine oil including the acid trapping agent is injected inside the outdoor refrigerant circuit 110*c* together with the working refrigerant so as to not collect inside the mixer 191.

The refrigerant circuit 110 of the updated air conditioner 101 is configured by connecting the aforementioned new indoor units 104 and 105 and the new outdoor unit 102 to the refrigerant communication pipes 6 and 7 serving as existing refrigerant pipes. Here, the existing refrigerating machine oil including the acid components remains inside the refrigerant communication pipes 6 and 7 to be appropriated because the refrigerant communication pipes 6 and 7 have only gone through the refrigerant recovery step S1.

<Test Operation Step S3>

Next, vacuuming of the indoor units 104 and 105 and the refrigerant communication pipes 6 and 7 is performed in a state where the liquid close valve 136 and the gas close valve 137 of the outdoor unit 2 are closed.

Thereafter, the liquid close valve 136 and the gas close valve 137 of the outdoor unit 102 are opened and the entire refrigerant circuit 110 of the updated air conditioner 101 is filled with the working refrigerant and the refrigerating machine oil including the acid trapping agent with which the outdoor unit 102 has been filled beforehand. It will be noted that, although sometimes the pipes comprising the existing refrigerant communication pipes 6 and 7 are long and the amount of working refrigerant with which the outdoor unit 102 has been filled beforehand does not satisfy the required refrigerant amount, further filling with the working refrigerant is performed from the outside in this case.

Next, acid component detoxification operation that detoxifies the acid components included in the existing refrigerating machine oil remaining in the refrigerant communication pipes 6 and 7 is performed. Here, acid component detoxification operation is operation that detoxifies the acid components by mixing the acid components with the acid trapping agent and neutralizing the acid components inside the mixer 191 disposed in the updated refrigerant circuit 101 prior to normal operation step S4 in order to prevent deterioration of the working refrigerant and refrigerating machine oil filling the updated refrigerant circuit 110 resulting from acid components remaining in the refrigerant communication pipes 6 and 7 appropriated in the updated air conditioner 101 during normal refrigeration cycle operation (normal operation step S4) including cooling operation and heating operation.

Figure 5:
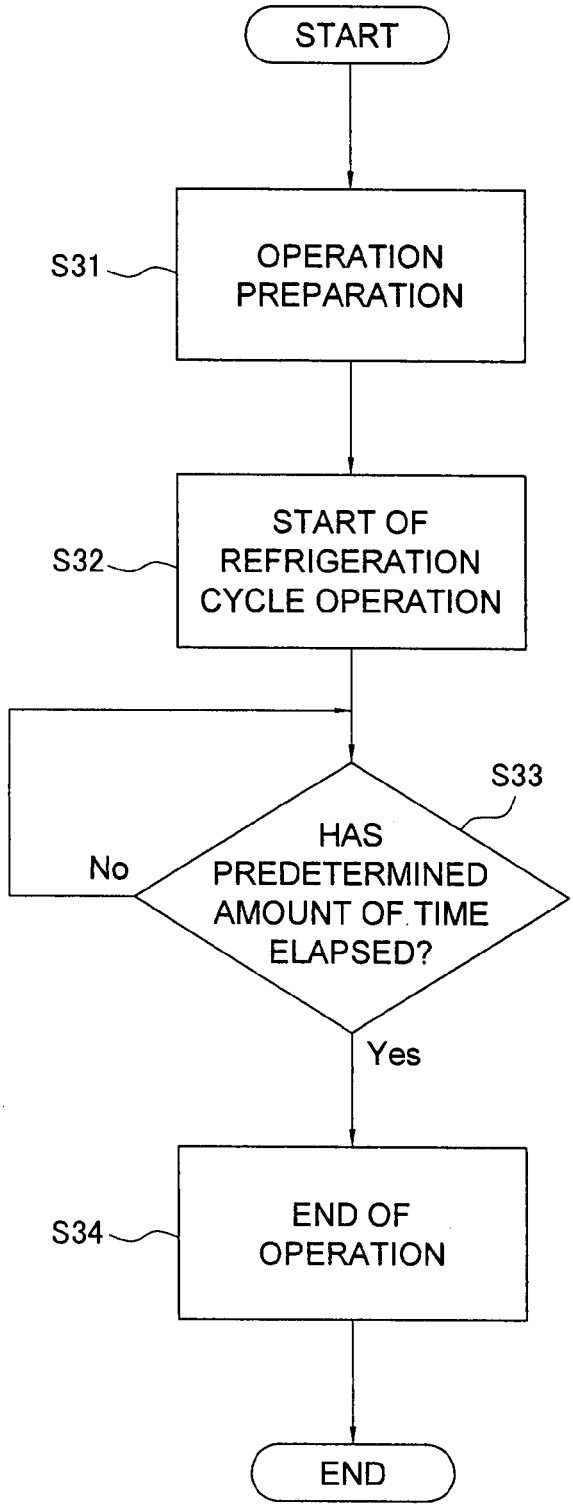
FIG. 5 is a flowchart showing the process of acid component detoxification operation.

Next, the working of acid component detoxification operation will be described using FIG. 2 and FIG. 5. Here, FIG. 5 is a flowchart showing the process of acid component detoxification operation.

First, in acid component detoxification operation preparation step S31, the mixer 191 is placed in a usable state. That is, the intake pipe open/close valve 130*a* is closed and the lead-in pipe open/close valve 192*a* is opened. Further, the oil lead-out pipe open/close valve 194*b* is closed such that the refrigerating machine oil can be collected inside the mixer 191.

Next, in refrigeration cycle operation step S32, refrigeration cycle operation that is the same as cooling operation is performed in the state where the mixer 191 is usable. Specifically, the compressor 121, the outdoor fan 127, and the indoor fans 143 and 153 are started with the four-way switch valve 122 being in the state represented by the solid lines in FIG. 2, that is, a state where the discharge side of the compressor 121 is connected to the gas side of the outdoor heat exchanger 123 and where the intake side of the compressor 121 is connected to the gas sides of the indoor heat exchangers 142 and 152, and with the outdoor expansion valve 124 being opened. When this happens, working refrigerant in a low-pressure gas state is taken into the compressor 121 through the intake pipe 130, is compressed, and becomes working refrigerant in a high-pressure gas state. Thereafter, the working refrigerant in the high-pressure gas state is sent to the outdoor heat exchanger 123 via the four-way switch valve 122, is condensed as a result of heat exchange being performed with the outdoor air supplied by the outdoor fan 127, and becomes working refrigerant in a high-pressure liquid state. Additionally, the working refrigerant in the high-pressure liquid state is sent to the receiver 125 via the outdoor expansion valve 124, temporarily collected inside the receiver 125, and thereafter sent to the indoor units 104 and 105 via the liquid close valve 136 and the liquid refrigerant communication pipe 6. The working refrigerant in the high-pressure liquid state sent to the indoor units 104 and 105 is depressurized by the indoor expansion valves 141 and 151 whose openings are regulated so as to regulate the flow rate of the working refrigerant flowing through the indoor heat exchangers 142 and 152, becomes working refrigerant in a low-pressure gas-liquid two-phase state, is sent to the indoor heat exchangers 142 and 152, is evaporated as a result of heat exchange being performed with the room air in the indoor heat exchangers 142 and 152, and becomes working refrigerant in a low-pressure gas state. The working refrigerant in the low-pressure gas state is sent to the outdoor unit 102 via the gas refrigerant communication pipe 7, flows into the intake pipe 130 via the gas close valve 137 and the four-way switch valve 122, and is again taken into the compressor 121.

Here, in the aforementioned acid component detoxification preparation step S31, the working refrigerant in the low-pressure gas state flowing into the intake pipe 130 is led into the mixer 191 through the lead-in pipe 192 because the mixer 191 is in the usable state. When the working refrigerant led into the mixer 191 passes through the refrigerant communication pipes 6 and 7, it flows while stripping and washing away the existing refrigerating machine oil including the acid components so that the existing refrigerating machine oil including the acid components is also led into the mixer 191. Further, during refrigeration cycle operation, the refrigerating machine oil including the acid trapping agent that is filled together with the updated working refrigerant circulates inside the refrigerant circuit 110, so the refrigerating machine oil including the acid trapping agent also accompanies the working refrigerant in the low-pressure gas state in being led into the mixer 191. Additionally, the working refrigerant in the low-pressure gas state led into the mixer 191 is gas/liquid-separated inside the mixer 191 from the existing refrigerating machine oil including the acid components and from the refrigerating machine oil including the acid trapping agent and is returned to the intake pipe 130 through the lead-out pipe 193. At this time, it is difficult for droplets of the refrigerating machine oil to accompany the working refrigerant in the low-pressure gas state in being led out because the filter 193*a* is disposed in the lead-out pipe 193.

Further, the existing refrigerating machine oil including the acid components and the refrigerating machine oil including the acid trapping agent gas/liquid-separated from the working refrigerant in a low-pressure gas state collects in the lower portion of the mixer 191. Thus, the amount of time of contact between the acid components included in the existing refrigerating machine oil led into the mixer 191 and the refrigerating machine oil including the acid trapping agent becomes longer so that the mixer 191 can promote mixing between the acid components and the acid trapping agent and can promptly and reliably cause the acid components to react with the acid trapping agent and detoxify the acid components. Further, in the present embodiment, the oil lead-out pipe open/close valve 194*b* is closed until a predetermined amount of time elapses in later-described operation time counting step S33, so the amounts of the existing refrigerating machine oil including the acid components and the refrigerating machine oil including the acid trapping agent collecting in the lower portion of the mixer 191 gradually increase. Thus, the amount of time of contact between the acid components included in the existing refrigerating machine oil led into the mixer 191 and the refrigerating machine oil including the acid trapping agent becomes even longer, so that the mixer 191 can further promote mixing between the acid components and the acid trapping agent.

Next, in operation time counting step S33, the flow moves to acid component detoxification operation end step S34 when it is judged that the operation time of refrigeration cycle operation using the aforementioned mixer 191 has exceeded a predetermined amount of time.

Next, in acid component detoxification operation end step S34, the mixer 191 is placed in a usable state by the following sequence. Specifically, the oil lead-out pipe open/close valve 194*b* is opened, mixing between the acid components and the acid trapping agent inside the mixer 191 ends, the refrigerating machine oil including the existing refrigerating machine oil whose acid components have been detoxified is returned to the intake pipe 130, the intake pipe open/close valve 130*a* is opened, the lead-in pipe open/close valve 192*a* is closed, and the flow moves to normal refrigeration cycle operation including cooling operation and heating operation. Here, solid contaminants such as dirt that has been led into the mixer 191 together with the refrigerating machine oil by the working refrigerant collects in the bottom portion of the mixer 191, so that when the oil lead-out pipe open/close valve 194*b* is opened, the solid contaminants is led out from the inside of the mixer 191, but the contaminants is not sent to the intake pipe 130 because the filter 194*a* is disposed upstream of the oil lead-out pipe open/close valve 194*b*.

It will be noted that the controller 108 functions as acid component detoxification operation control means for performing the aforementioned acid component detoxification operation.

<Normal Operation Step S4>

In normal operation step S4, cooling operation and heating operation that are the same as those in the existing air conditioner 1 are performed. It will be noted that, because those operations are the same as the aforementioned cooling operation and heating operation in the existing air conditioner 1, description thereof will be omitted here because, with respect to the description of operation during normal operation in the existing air conditioner 1, FIG. 2 may be substituted for FIG. 1 and reference numerals to which 10 has been added may be substituted for reference numerals representing the respective parts excluding the refrigerant communication pipes 6 and 7.

Additionally, during cooling operation and heating operation, at the end of the aforementioned test operation step S3 (specifically, acid component detoxification operation), the refrigerating machine oil including the existing refrigerating machine oil that has been returned to the intake pipe 130 circulates inside the updated refrigerant circuit 110, but a situation where the working refrigerant and the refrigerating machine oil deteriorate due to the acid components stemming from the existing air conditioner 1 does not arise because the acid components that had remained in the refrigerant communication pipes 6 and 7 have already been detoxified.

(4) Characteristics of Air Conditioner Updating Method and Updated Air Conditioner The method of appropriating the refrigerant communication pipes 6 and 7 of the existing air conditioner 1 of the present embodiment to update to the air conditioner 101, and the updated air conditioner 101, have the following characteristics.

(A)

In the air conditioner updating method and the updated air conditioner 101 of the present embodiment, during acid component detoxification operation serving as refrigeration cycle operation in test operation step S3, reaction between the acid components included in the existing refrigerating machine oil remaining in the refrigeration communication pipes 6 and 7 serving as existing refrigerant pipes after refrigerant recovery step S1 and the acid trapping agent filled together with the working refrigerant and the refrigerating machine oil in device updating step S2 can be promoted by the mixer 191 disposed in the refrigerant circuit 110 of the updated air conditioner 101, and the acid components remaining in the refrigerant communication pipes 6 and 7 can be promptly detoxified.

(B)

In the updated air conditioner 101 of the present embodiment, the mixer 191 is disposed such that the working refrigerant flowing through the intake pipe 130 of the compressor 121 passes through the inside of the mixer 191, so that during acid component detoxification operation, the acid components can be mixed with the acid trapping agent before the working refrigerant is taken into the compressor 121, and inflow of the acid components into the compressor 121 can be controlled.

(C)

In the air conditioner updating method and the updated air conditioner 101 of the present embodiment, the refrigerating machine oil (specifically, the existing refrigerating machine oil and the updated refrigerating machine oil) can be collected inside the mixer 191, so that the amount of time of contact between the acid components included in the existing refrigerating machine oil led into the mixer 191 together with the working refrigerant and the refrigerating machine oil including the acid trapping agent becomes longer, and mixing between the acid components and the acid trapping agent can be promoted.

(D)

In the updated air conditioner 101 of the present embodiment, the mixer 191 is connected to the intake pipe 130 of the compressor 121 by the lead-in pipe 192 and by the lead-out pipe 193, so that the working refrigerant flowing through the intake pipe 130 of the compressor 121 can be led into the mixer 191 so as to bypass part of the intake pipe 130 of the compressor 121 and be again returned to the intake pipe 130 of the compressor 121.

Moreover, the intake pipe open/close valve 130*a* serving as an intake pipe open/close mechanism is disposed in the intake pipe 130, so that all of the working refrigerant flowing through the intake pipe 130 of the compressor 121 can be led into the mixer 191 and be again returned to the intake pipe 130 of the compressor 121.

Thus, inflow of the acid components into the compressor 121 can be reliably controlled.

(E)

In the updated air conditioner 101 of the present embodiment, the oil lead-out pipe 194 for returning the refrigerating machine oil (specifically, the existing refrigerating machine oil and the updated refrigerating machine oil) collected inside the mixer 191 to the intake pipe 130 of the compressor 121 is disposed, and the refrigerating machine oil whose acid components have been detoxified as a result of being mixed with the acid trapping agent and neutralized inside the mixer 191 can be returned to the intake pipe 130 of the compressor 121, so that inflow of the acid components into the compressor 121 can be further controlled.

(F)

In the air conditioner updating method and the updated air conditioner 101 of the present embodiment, at the end of test operation step S3 (specifically, acid component detoxification operation end step S34 of acid component detoxification operation), the amount of time of contact between the acid components and the refrigerating machine oil including the acid trapping agent inside the mixer 191 is lengthened and mixing between the acid components and the acid trapping agent can be further promoted and the refrigerating machine oil can be rapidly returned to the intake pipe 130 of the compressor 121 after mixing ends because the oil lead-out pipe open/close valve 1 94*b* serving as an oil lead-out pipe open/close mechanism disposed in the oil lead-out pipe 194.

(5) First Modification

In the aforementioned embodiment, the outdoor refrigerant circuit 110*c* of the outdoor unit 102 is filled with predetermined amounts of the working refrigerant and the refrigerating machine oil including the acid trapping agent before the outdoor unit 102 is transported to the installation site, and at this time, it is filled such that the refrigerating machine oil including the acid trapping agent does not collect inside the mixer 191. For this reason, during acid component detoxification operation of test operation step S3, the existing refrigerating machine oil including the acid components and the updated refrigerating machine oil including the acid trapping agent gradually collect inside the mixer 191 and mixing between the acid components and the acid trapping agent is performed.

In contrast, in the outdoor unit 102 of the present modification, in contrast to the aforementioned embodiment, the refrigerating machine oil including the acid trapping agent filling the inside of the outdoor refrigerant circuit 110*c* fills and collects inside the mixer 191 before the outdoor unit is transported to the installation site (i.e., before the start of acid component detoxification operation of test operation step S3). For this reason, immediately after the start of acid component detoxification operation of the aforementioned test operation step S3, there is a tendency for a relatively large amount of the existing refrigerating machine oil including the acid components that had remained in the refrigerant communication pipes 6 and 7 to be led into the mixer 191 together with the working refrigerant, but in such a case, the acid components included in the refrigerating machine oil led into the mixer 191 can be promptly and reliably mixed with the acid trapping agent.

(6) Second Modification

In the aforementioned embodiment, separate from detoxification of the acid components included in the refrigerating machine oil that had remained in the refrigerant communication pipes 6 and 7 serving as existing refrigerant pipes, it is conceivable to add the acid trapping agent when filling the working refrigerant and the refrigerating machine oil for the purpose of preventing deterioration of the working refrigerant and the refrigerating machine oil after starting normal refrigeration cycle operation (i.e., normal operation step S4) of the updated air conditioner 101. In this case, by performing acid component detoxification operation of the aforementioned test operation step S3, the amount of the acid trapping agent capable of reacting with the acid components becomes reduced during normal refrigeration cycle operation of the updated air conditioner 101.

In contrast, in acid component detoxification operation of the present modification, additional refrigerating machine oil including the acid trapping agent is added to the inside of the updated air conditioner 101 during acid component detoxification operation end step S34, so that the acid trapping agent capable of reacting with the acid components can be replenished during normal refrigeration cycle operation of the updated air conditioner 101.

Figure 6:
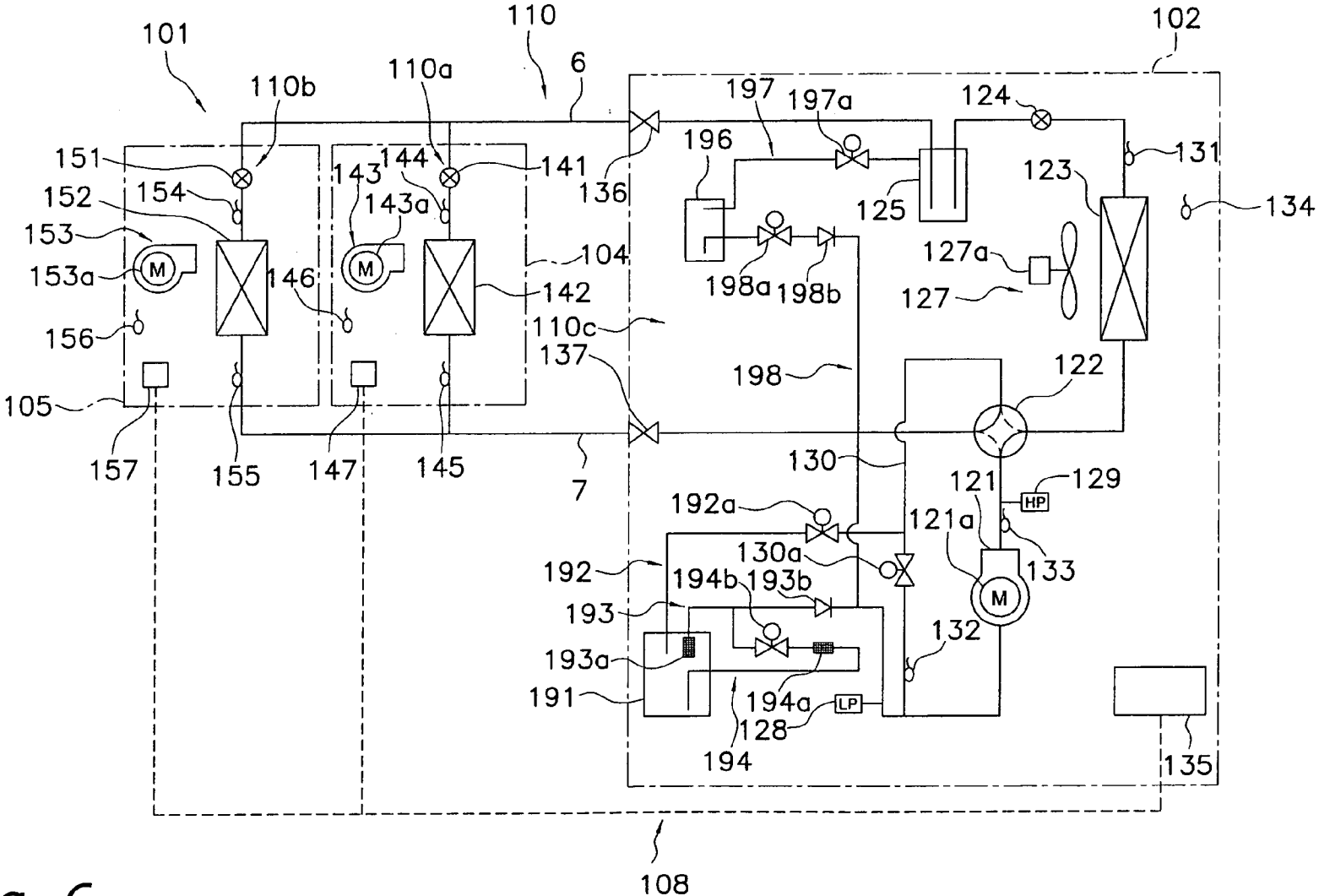
FIG. 6 is a schematic configural diagram of an updated air conditioner pertaining to a second modification.

As a configuration for adding additional refrigerating machine oil including the acid trapping agent, it is conceivable to dispose an oil regulator 196 such as shown in FIG. 6 in the outdoor refrigerant circuit 110*c* of the outdoor unit 102 and fill the inside of the mixer 191 with the refrigerating machine oil including the acid trapping agent before transporting the outdoor unit 102 to the installation site (i.e., before the start of acid component detoxification operation of test operation step S3). The oil regulator 196 is a container capable of collecting thereinside the refrigerating machine oil including the acid trapping agent, and is connected to the outdoor refrigerant circuit 110*c* by a pressurization pipe 197 that communicates the upper portion of the receiver 125 and the upper portion of the oil regulator 196 and by a replenishment pipe 198 that leads the refrigerating machine oil including the acid trapping agent out from the lower portion of the receiver 125 to the intake pipe 130 of the compressor 121. Here, a pressurization pipe open/close valve 197*a* comprising an electromagnetic valve capable of cutting off the flow of the working refrigerant from the receiver 125 to the oil regulator 196 is disposed in the pressurization pipe 197. Further, disposed in the replenishment pipe 198 are a replenishment pipe open/close valve 198*a* comprising an electromagnetic valve capable of cutting off the flow of the working refrigerant from the oil regulator 196 to the intake pipe 130 and a replenishment pipe check valve 198*b* capable of allowing the flow that causes the refrigerating machine oil including the acid trapping agent led out from the oil regulator 196 to flow into the intake pipe 130 and cutting off the flow where the working refrigerant flows into the oil regulator 196 from the intake pipe 130. Additionally, similar to the other devices and valves, the pressurization pipe open/close valve 197*a* and the replenishment pipe open/close valve 198*a* are controlled by the controller 108 (specifically, the outdoor Controller 135) of the updated air conditioner 101.

Thus, during the acid component detoxification operation end step S34 in acid component detoxification operation, the pressurization pipe open/close valve 197*a* and the replenishment pipe open/close valve 198*a* are opened so that the inside of the refrigerant circuit 110 can be filled, through the intake pipe 130, with the refrigerating machine oil including the acid trapping agent collecting inside the oil regulator 196, and a situation where the acid trapping agent capable of reacting with the acid components becomes reduced can be prevented during normal refrigeration cycle operation of the updated air conditioner 101.

(7) Other Embodiments

Embodiments of the present invention has been described above on the basis of the drawings, but the specification configuration thereof is not limited to these embodiments and is alterable within a range that does not depart from the gist of the invention.

(A) The numbers of indoor units and outdoor units are not limited to those in the aforementioned embodiments.

(B) In the aforementioned embodiments, the present invention is applied to an air-cooling air conditioner, but the present invention may also be applied to a water-cooling air conditioner and an ice thermal storage air conditioner.

(C) In the preceding embodiments, both the outdoor unit and the indoor units are updated, but the present invention is not limited to this and is also applicable to updating just the outdoor unit.

(D) The shape of the mixer is not limited to the vertical circular cylinder shape of the aforementioned embodiments. Further, the disposition of the lead-in pipe, the lead-out pipe, and the oil lead-out pipe connected to the mixer is not limited to that of the aforementioned embodiments.

(E) In the preceding embodiments, acid component detoxification operation is implemented by refrigeration cycle operation that is the same as cooling operation, but it may also be implemented by refrigeration cycle operation that is the same as heating operation.

INDUSTRIAL APPLICABILITY

By utilizing the present invention, there can be provided a configuration and updating method capable of promptly detoxifying acid components remaining in existing refrigerating pipes of a separate-type air conditioner when the existing refrigerant pipes are appropriated to update an outdoor unit and indoor units.

The invention claimed is:

1. An air conditioner configured by appropriating existing refrigerant pipes of an existing air conditioner to update a refrigerant circuit of the existing air conditioner, the existing air conditioner utilizing an existing refrigerant and an existing refrigerating machine oil, the existing refrigerant being a chlorofluorocarbon (CFC) or a hydrochlorofluorocarbon (HCFC) refrigerant, and the existing refrigerating machine oil being a mineral oil or an alkyl benzene, the air conditioner comprising:

an updated refrigerant circuit including a compressor, a heat source heat exchanger, an expansion mechanism, a utilization heat exchanger, and the existing refrigerant pipes, the updated refrigerant circuit being filled with a working refrigerant and a working refrigerating machine oil that includes an acid trapping agent that detoxifies acid components remaining in the existing refrigerant pipes, the working refrigerant being a hydrofluorocarbon (HFC) refrigerant, and the working refrigerating machine oil being an ethereal or ester oil;

a mixer disposed in the updated refrigerant circuit to mix the acid components with the acid trapping agent during a refrigeration cycle operation of the updated refrigerant circuit, the mixer being disposed such that the working refrigerant flowing through an intake pipe of the compressor passes through an inside of the mixer, and the mixer being configured to collect the working refrigerating machine oil; and an oil lead-out pipe connected to the mixer that is configured to return the working refrigerating machine oil collected inside the mixer to the intake pipe of the compressor.

2. The air conditioner of claim 1, wherein the mixer is connected to the intake pipe of the compressor by a lead-in pipe that branches from the intake pipe of the compressor and by a lead-out pipe that branches from the intake pipe of the compressor at a position downstream of the position where the lead-in pipe branches.

3. The air conditioner of claim 2, wherein an intake pipe open/close mechanism capable of cutting off the flow of the working refrigerant is disposed in the intake pipe of the compressor between the position where the lead-in pipe branches and the position where the lead-out pipe branches.

4. The air conditioner of claim 3, wherein the mixer is filled with the working refrigerating machine oil including the acid trapping agent before the start of the refrigeration cycle operation.

5. The air conditioner of claim 2, wherein the mixer is filled with the working refrigerating machine oil including the acid trapping agent before the start of the refrigeration cycle operation.

6. The air conditioner of claim 1, further comprising an oil lead-out pipe open/close mechanism arranged to cut off the flow that returns the working refrigerating machine oil collected inside the mixer to the intake pipe of the compressor is disposed in the oil lead-out pipe.

7. The air conditioner of claim 6, wherein the mixer is filled with the working refrigerating machine oil including the acid trapping agent before the start of the refrigeration cycle operation.

8. The air conditioner of claim 1, wherein the mixer is filled with the working refrigerating machine oil including the acid trapping agent before the start of the refrigeration cycle operation.

9. An air conditioner configured by appropriating existing refrigerant pipes of an existing air conditioner to update a refrigerant circuit of the existing air conditioner, the existing air conditioner utilizing an existing refrigerant and an existing refrigerating machine oil, the existing refrigerant being a chlorofluorocarbon (CFC) or a hydrochlorofluorocarbon (HCFC) refrigerant, and the existing refrigerating machine oil being a mineral oil or an alkyl benzene, the air conditioner comprising:

an updated refrigerant circuit including a compressor, a heat source heat exchanger, an expansion mechanism, a utilization heat exchanger, an oil regulator and the existing refrigerant pipes, the updated refrigerant circuit being filled with a working refrigerant and a working refrigerating machine oil that includes an acid trapping agent that detoxifies acid components remaining in the existing refrigerant pipes, the working refrigerant being a hydrofluorocarbon (HFC) refrigerant, and the working refrigerating machine oil being an ethereal or ester oil; and a mixer disposed in the updated refrigerant circuit to mix the acid components with the acid trapping agent during a refrigeration cycle operation of the updated refrigerant circuit, the mixer being disposed such that the working refrigerant flowing through an intake pipe of the compressor passes through an inside of the mixer, the mixer being configured to collect the working refrigerating machine oil, and the mixer being filled with the working refrigerating machine oil including the acid trapping agent before the start of the refrigeration cycle operation, the oil regulator being connected to the intake pipe and being used to fill the updated refrigerant circuit with the working refrigerating machine oil.

10. A heat source unit used in an air conditioner configured by appropriating existing refrigerant pipes of an existing air conditioner to update a refrigerant circuit of the existing air conditioner, the existing air conditioner utilizing an existing refrigerant and an existing refrigerating machine oil, the existing refrigerant being a hydrochlorofluorocarbon (HCFC) or refrigerant, and the existing refrigerating machine oil being a mineral oil or an alkyl benzene, the heat source unit comprising:

a heat source refrigerant circuit including a compressor and a heat source heat exchanger, the heat source refrigerant circuit being filled with a working refrigerant and a working refrigerating machine oil that includes an acid trapping agent that detoxifies acid components remaining in the existing refrigerant pipes, the working refrigerant being a hydrofluorocarbon (HFC) refrigerant, and the working refrigerating machine oil being an ethereal or ester oil;

a mixer disposed in the heat source refrigerant circuit to mix the acid components with the acid trapping agent during a refrigeration cycle operation after configuring an updated refrigerant circuit including the existing refrigerant pipes and the heat source refrigerant circuit, the mixer being disposed such that the working refrigerant flowing through an intake pipe of the compressor passes through an inside of the mixer, and the mixer being configured to collect the working refrigerating machine oil; and an oil lead-out pipe connected to the mixer that is configured to return the working refrigerating machine oil collected inside the mixer to the intake pipe of the compressor.

11. An air conditioner updating method that appropriates existing refrigerant pipes of an existing air conditioner provided with a vapor compression-type refrigerant circuit to update a refrigerant circuit of the existing air conditioner, the existing air conditioner utilizing an existing refrigerant and an existing refrigerating machine oil, the existing refrigerant being a chlorofluorocarbon (CFC) or a hydrochlorofluorocarbon (HCFC) refrigerant, and the existing refrigerating machine oil being a mineral oil or an alkyl benzene, the method comprising:

recovering the existing refrigerant including the existing refrigerating machine oil from the existing air conditioner;

configuring an updated vapor compression-type refrigerant circuit filled with a working refrigerant and a working refrigerating machine oil that include an acid trapping agent that detoxifies acid components remaining in the existing refrigerant pipes, the working refrigerant being a hydrofluorocarbon (HFC) refrigerant, and the working refrigerating machine oil being an ethereal or ester oil;

disposing in the updated vapor compression-type refrigerant circuit a mixer that mixes the acid components with the acid trapping agent by collecting the working refrigerating machine oil in the mixer; and performing a refrigeration cycle operation of the updated refrigerant circuit such that the working refrigerant passes through an inside of the mixer; and returning the working refrigerating machine oil collected inside the mixer to an inside of the updated vapor compression-type refrigerant circuit.

12. The air conditioner updating method of claim 11, wherein the mixer is filled with the working refrigerating machine oil including the acid trapping agent before performing the refrigeration cycle operation.

13. An air conditioner updating method that appropriates existing refrigerant pipes of an existing air conditioner provided with a vapor compression-type refrigerant circuit to update a refrigerant circuit of the existing air conditioner, the existing air conditioner utilizing an existing refrigerant and an existing refrigerating machine oil, the existing refrigerant being a chlorofluorocarbon (CFC) or a hydrochlorofluorocarbon (HCFC) refrigerant, and the existing refrigerating machine oil being a mineral oil or an alkyl benzene, the method comprising:

recovering the existing refrigerant including the existing refrigerating machine oil from the existing air conditioner;

configuring an updated vapor compression-type refrigerant circuit filled with a working refrigerant and a working refrigerating machine oil that includes an acid trapping agent that detoxifies acid components remaining in the existing refrigerant pipes, the working refrigerant being a hydrofluorocarbon (HFC) refrigerant, and the working refrigerating machine oil being an ethereal or ester oil;

disposing in the updated vapor compression-type refrigerant circuit a mixer that mixes the acid components with the acid trapping agent by collecting the working refrigerating machine oil in the mixer; and performing a refrigeration cycle operation of the updated refrigerant circuit such that the working refrigerant passes through an inside of the mixer, with the mixer being filled with the working refrigerating machine oil including the acid trapping agent before performing the refrigeration cycle operation, the updated vapor compression-type refrigerant circuit being filled with the working refrigerant machine oil from an oil regulator via an intake pipe of a compressor of the updated vapor compression-type refrigerating circuit.

14. A heat source unit used in an air conditioner configured by appropriating existing refrigerant pipes of an existing air conditioner to update a refrigerant circuit of the existing air conditioner, the existing air conditioner utilizing an existing refrigerant and an existing refrigerating machine oil, the existing refrigerant being a hydrochlorofluorocarbon (HCFC) or refrigerant, and the existing refrigerating machine oil being a mineral oil or an alkyl benzene, the heat source unit comprising:

a heat source refrigerant circuit including a compressor, an oil regulator and a heat source heat exchanger, the heat source refrigerant circuit being filled with a working refrigerant and a working refrigerating machine oil that includes an acid trapping agent that detoxifies acid components remaining in the existing refrigerant pipes, the working refrigerant being a hydrofluorocarbon (HFC) refrigerant, and the working refrigerating machine oil being an ethereal or ester oil; and a mixer disposed in the heat source refrigerant circuit to mix the acid components with the acid trapping agent during a refrigeration cycle operation after configuring an updated refrigerant circuit including the existing refrigerant pipes and the heat source refrigerant circuit, the mixer being disposed such that the working refrigerant flowing through an intake pipe of the compressor passes through an inside of the mixer, the mixer being configured to collect the working refrigerating machine oil, and the mixer being filled with the working refrigerating machine oil including the acid trapping agent before the start of the refrigeration cycle operation, the oil regulator being connected to the intake pipe and being used to fill the updated refrigerant circuit with the working refrigerating machine oil.

* * * * *